US010136792B2

(12) United States Patent
Bak et al.

(10) Patent No.: US 10,136,792 B2
(45) Date of Patent: Nov. 27, 2018

(54) HOUSEHOLD APPLIANCE

(75) Inventors: Michael Bak, Dettingen/Teck (DE); Markus Höpfl, Lauingen (DE); Jürgen Kratzer, Dillingen (DE); Udo Maier, Söhnstetten (DE)

(73) Assignee: BSH Hausgeräte GmbH, Munich (DE)

( * ) Notice: Subject to any disclaimer, the term of this patent is extended or adjusted under 35 U.S.C. 154(b) by 1788 days.

(21) Appl. No.: 13/286,249

(22) Filed: Nov. 1, 2011

(65) Prior Publication Data

US 2012/0104913 A1 May 3, 2012

(30) Foreign Application Priority Data

Nov. 3, 2010 (DE) ..... 10 2010 043 270

(51) Int. Cl.

| | |
|---|---|
| ***B65D 81/02*** | (2006.01) |
| ***B65D 81/05*** | (2006.01) |
| ***A47L 15/42*** | (2006.01) |
| ***B65D 85/48*** | (2006.01) |
| ***B65D 85/68*** | (2006.01) |

(52) U.S. Cl.

CPC ..... *A47L 15/4268* (2013.01); *B65D 81/053* (2013.01); *B65D 85/48* (2013.01); *B65D 85/68* (2013.01); *B65D 2585/6815* (2013.01); *B65D 2585/6855* (2013.01)

(58) Field of Classification Search

CPC ..... B65D 81/107; B65D 81/1075; B65D 81/113; B65D 85/64; B65D 2585/6812; B65D 2585/6815; B65D 2585/682; B65D 2585/6825; B65D 2585/6855; B65D 81/053; B65D 81/054; B65D 81/055; B65D 2581/053; B65D 2581/055; A47L 15/4246; A47L 15/42

USPC ..... 312/228, 257.1, 311; 206/586, 320, 521, 206/453

See application file for complete search history.

(56) References Cited

U.S. PATENT DOCUMENTS

| | | | | | |
|---|---|---|---|---|---|
| 3,049,260 | A * | 8/1962 | Stone | B65D 81/054 | 206/586 |
| 3,531,040 | A * | 9/1970 | Josephus | B65D 81/107 | 206/523 |
| 3,870,152 | A * | 3/1975 | Kaplan | B65D 81/053 | 206/523 |
| 3,901,995 | A * | 8/1975 | Conlon | B65D 81/054 | 206/586 |
| 4,746,177 | A * | 5/1988 | Lampman | A47L 15/4246 | 248/188.8 |
| 4,811,840 | A * | 3/1989 | Muyskens | 206/320 | |
| 4,851,286 | A * | 7/1989 | Maurice | B32B 5/32 | 428/316.6 |

(Continued)

FOREIGN PATENT DOCUMENTS

| | | | | |
|---|---|---|---|---|
| DE | 4446961 | A1 | 7/1996 | |
| DE | 102007052072 | A1 * | 5/2009 | A47L 15/4268 |

(Continued)

*Primary Examiner* — Kimberley S Wright

(74) *Attorney, Agent, or Firm* — Michael E. Tschupp; Andre Pallapies; Brandon G. Braun

(57) ABSTRACT

A household appliance, in particular a dishwasher, includes at least one packing element disposed on a side face of the household appliance, and at least one load-bearing structural part. The packing element has at least one force transfer region, which has a force action surface in contact with the load-bearing structural part.

27 Claims, 2 Drawing Sheets

(56) References Cited

U.S. PATENT DOCUMENTS 5,549,760 A * 8/1996 Becker ..... 134/25.2
5,992,954 A * 11/1999 Becker ..... A47L 15/4272 134/58 D
6,155,419 A * 12/2000 Sowa ..... B65D 75/004 206/320
6,764,147 B2 * 7/2004 Flowers ..... 312/228
6,988,615 B2 * 1/2006 Merkel ..... B65D 81/057 206/320
7,686,169 B1 * 3/2010 Harte ..... B65D 81/03 206/453
8,440,027 B2 * 5/2013 Buhlmeyer ..... A47L 15/4246 134/114
9,155,445 B2 * 10/2015 Horsch ..... F24C 15/08
2002/0166860 A1 * 11/2002 Giles ..... B65D 81/056 220/523
2003/0115833 A1 * 6/2003 Richey ..... B65B 5/04 53/139.7
2008/0127456 A1 * 6/2008 Maunsell ..... A47B 77/08 16/400
2009/0126765 A1 * 5/2009 Buehlmeyer ..... A47L 15/4246 134/115 R
2010/0045150 A1 * 2/2010 Laible et al. ..... 312/237
2010/0109497 A1 * 5/2010 Blersch et al. ..... 312/405
2011/0012486 A1 1/2011 Fetzer et al.
2011/0132799 A1 * 6/2011 Lee ..... B65D 81/053 206/586
2012/0206027 A1 * 8/2012 Horsch ..... A47L 15/4272 312/228

FOREIGN PATENT DOCUMENTS

DE 102008032266 A1 * 1/2010 ..... A47L 15/4246
DE 102008032266 A1 1/2010
DE 102008042474 B3 4/2010
EP 1386853 A1 2/2004
JP 02296680 A * 12/1990
JP 2000264361 A * 9/2000
WO WO-2009068395 A1 * 6/2009 ..... A47L 15/4272

* cited by examiner

Section I-I

Section II-II

HOUSEHOLD APPLIANCE

BACKGROUND OF THE INVENTION

The invention relates to a household appliance, in particular a dishwasher, having at least one packing element disposed on a side face of the household appliance, the household appliance having at least one load-bearing structural part disposed in the uncovered region of the side face, for example a treatment container, or a carrying or support element.

Household appliances are generally packed at the factory and stored or delivered to customers as packages. Such packing is known from DE 44 46 961 C2, wherein corner pads made of Styropor are provided as individual pieces on the corner regions of the dishwasher. The corner pads are held by shrink wrap for example, which is wrapped tightly round the household appliance.

During the storage and transportation of such packages, when standard forklift trucks are used, external clamping forces are introduced into the dishwasher by way of the packing elements. In order to prevent damage to the household appliance in this process, according to DE 44 46 961 C2 force-absorbing parts are disposed on the load-bearing structural parts, which contribute to the rigidity and dimensional stability of the household appliance. They are disposed between the load-bearing part, for example a frame delimiting the loading opening or the wash container, and a housing side wall. As the external clamping forces are introduced, they are introduced by way of the external packing element and the housing side wall into the inner force-absorbing part, which transfers the external forces to the load-bearing structural part without other assemblies in the household appliance being damaged in the process.

The force path thus provided comprises a number of components, including the external packing element, the housing side wall, the inner force-absorbing part and the load-bearing structural part. The force-absorbing part is produced as a single component and matched in a complex production process to the contour of the load-bearing structural part and has to be fitted to the load-bearing structural part in an additional assembly stage.

BRIEF SUMMARY OF THE INVENTION

It is an object of the invention to provide a household appliance, in which the clamping forces occurring during storage and transportation can be introduced in a simple manner and with no major component outlay without damage into the household appliance.

According to the invention the packing element with its force transfer region is brought into contact with the load-bearing structural part during packing. This can be done indirectly by way of the side wall or directly, i.e. without the arrangement of housing side walls covering the side walls of the household appliance between the packing element and the load-bearing structural part. During unpacking the packing element is removed from the load-bearing structural part. In contrast to the prior art therefore there is no additional force-absorbing part present on the unpacked household appliance. The problem therefore does not arise that the force transfer region can interfere with the operation of the household appliance. The force transfer region of the packing element can even particularly preferably be pressed against the hinge support within a pivot path of a hinge lever, as described below, since there is no risk of pivot actuation of the appliance door mounted on the hinge lever in the packed state.

The inventive household appliance can be provided totally without housing outer walls, as is normal in particular with built-in appliances that can be built under units. Alternatively however the household appliance sides can be covered with housing outer walls at least in some regions. It is important here that the load-bearing structural part is preferably exposed so that it is accessible from outside. In view of this there is no need for example for housing side walls, as is anyway the case in particular with fully-integrated household appliances. In this instance the household appliance would be built into the installation position in a recess in the kitchen front between adjacent furniture panels in the direction of the appliance sides.

Simple correct positioning of the packing element and perfect force introduction into the load-bearing structural part are of major importance. The packing element can therefore be brought into contact with the load-bearing structural part with a form fit. The force action surface of the packing element can then be configured as a negative of the contact surface of the load-bearing structural part that interacts with it, it being possible for the force action surface and the corresponding contact surface to be configured in such a manner that their contours are tailored to one another. The packing element can preferably feature a positioning aid, to assist with the perfect positioning of the packing element.

The positioning aid can be integrated directly in the packing element as a positioning contour and can be made to connect with the load-bearing structural part with a form fit. Correspondingly the positioning aid can be configured directly in the packing element as a molded segment. This molded segment can preferably be configured from the same material as and/or as a single piece with the packing element.

The packing element can be made of a Styropor material in the manner known per se. In the force transfer region of the packing element the density of the Styropor material can be increased correspondingly to achieve greater material rigidity. The positioning aid can be configured in a simple production process as the packing element is being molded.

The packing element can be coupled with its positioning aid in a pre-assembly stage in a simple manner in a plug-type connection and/or in a clamped connection to the load-bearing structural part of the household appliance. The packing element can thus already be placed with positional accuracy on the load-bearing structural part by simple attachment.

The positioning aid of the packing element can preferably be brought into contact with the load-bearing structural part of the household appliance with a form fit. To this end the positioning aid can be configured as at least one projection on the packing element. The projection can be inserted into an outwardly open hollow profile of the load-bearing structural part. It is also possible to integrate the force transfer region of the packing element in the projection at the same time.

In the case of a dishwasher the load-bearing structural part according to one exemplary embodiment can be a support frame around a loading opening, which in cross section has an outwardly open U-profile. The packing element with its force transfer region can preferably be inserted into the U-profile. The force transfer region here can be configured on the above-mentioned projection of the packing element.

In order to ensure a damage-free introduction of force into the household appliance, the force action surface between the packing element and the load-bearing structural part should have correspondingly large dimensions. The force transfer region of the packing element can therefore preferably extend around an outer corner of the load-bearing structural part, in particular of the support frame.

As an alternative to the above-mentioned configuration of the positioning aid as a projection, it can also be molded into the packing element as a recess. The packing element with its recess can then be positioned on a corresponding, outwardly projecting projection of the load-bearing structural part. The recess can be enclosed by the force action surface for a compact embodiment of the packing element.

This outwardly projecting projection can particularly preferably be a folded connection point for connecting wall parts of the treatment container. The folded connection point therefore interacts on the one hand with the positioning aid of the packing element. On the other hand the dimensional stability and rigidity of the treatment container are particularly good in the region of the folded connection point and therefore ideally suited to force introduction.

In a further embodiment the load-bearing structural part can be a hinge support, to which a hinge lever of an appliance door of the household appliance is attached. In the case of a dishwasher hinge supports are generally provided laterally in each instance, being inserted as rigid sheet metal parts in an assembly base and supporting a hinge lever of the appliance door on the outside in the appliance side direction in each instance. The wash container is supported within the hinge supports in the appliance side direction.

The hinge lever here can be disposed laterally outside the hinge support between the hinge support and the packing element. As external force is introduced, the packing element can press directly onto the hinge support.

When the household appliance is unpacked, the packing element is removed. The force transfer region of the packing element can therefore be disposed without further ado within the pivot path of the hinge lever, as set out above.

In a further embodiment the packing element with its force transfer region can be in direct contact with a bottom assembly support, on which the treatment container is supported. The assembly support is generally configured in the manner of a frame with a peripheral vertical side wall, which can be pressed into contact with the packing element.

The appliance packing can preferably feature a series of separate packing elements, each being provided for the corner regions of the household appliance. To provide greater rigidity the packing elements can be connected together by means of additional bridging elements, for example a wood or plastic strip.

In a further embodiment provision is made for the packing element and the force transfer region to be configured from the same material and/or as a single piece. The packing element therefore has a particularly simple structure. Provision can however also be made for the packing element with the force transfer region to be made for example from at least two different materials, which have different mechanical properties, which are assigned to the respective regions, e.g. to the packing element with greater flexibility and to the force transfer region with greater rigidity. It can for example be a plastic part, which has been produced in two work stages as a single piece or the two elements were made separately and then connected to one another in a subsequent stage.

BRIEF DESCRIPTION OF THE DRAWINGS

An exemplary embodiment of the invention is described below with reference to the accompanying figures, in which.

DETAILED DESCRIPTION OF EXEMPLARY EMBODIMENTS OF THE PRESENT INVENTION

Figure 1:
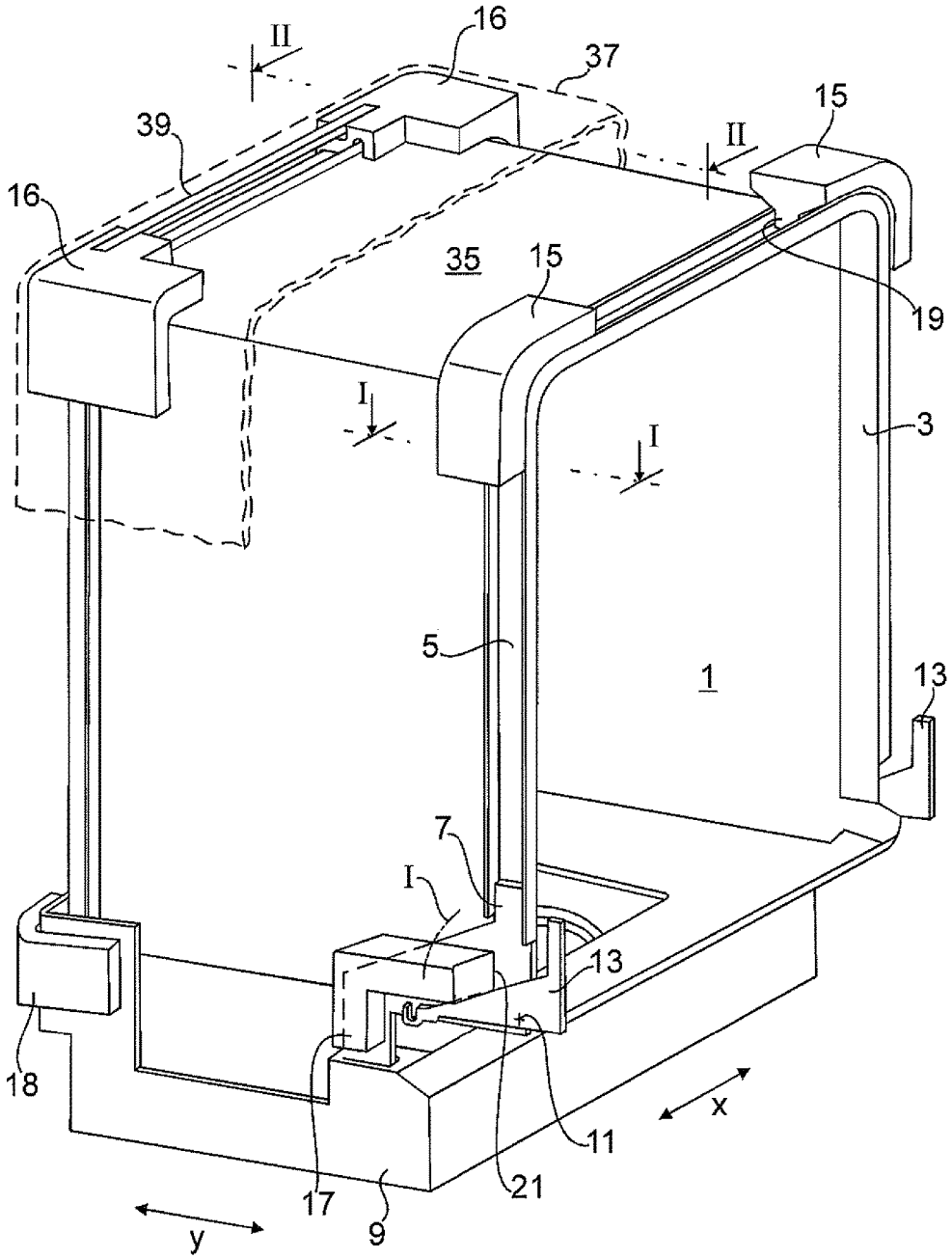
FIG. 1 shows a perspective view of a dishwasher indicating the appliance packing.

FIG. 1 shows a schematic spatial view of an exemplary embodiment of a household appliance in the form of a dishwasher, which has a wash container 1 with a front loading opening 3. The front loading opening 3 is enclosed by a support frame 5, which has an outwardly open U-profile in cross section. The support frame 5 here is fitted with its lateral vertical strips on lateral hinge supports 7. The two lateral hinge supports 7 are in turn inserted by way of arms that project vertically downwards in a bottom assembly support 9.

In the appliance side direction x outside the two hinge supports 7 hinge levers 13 of an appliance door (not shown here for the purposes of clarity) are connected respectively to hinge points 11. The appliance door is used to close the loading opening 3. The wash container 1 is also supported in the depthwise direction y at the back at its lower corner regions within the frame-type assembly support 9.

The dishwasher shown in FIG. 1 is embodied as a fully integrated appliance in the present exemplary embodiment. In the illustrated dishwasher therefore there are no housing side walls covering the side faces, which would otherwise conceal the load-bearing structural parts, specifically the support frame 5, hinge supports 7 and/or the wash container with the associated appliance assemblies, such as the water inlet or other appliance components. Such appliance assemblies are not shown in FIG. 1 for reasons of clarity.

The thus outwardly exposed structural parts 1, 5, 7, 9 in the present exemplary embodiment are in direct contact with packing elements 15 to 18 of the appliance packing, which overall consist of eight separate packing elements. These are provided respectively at the corner regions of the dishwasher with an outlined shrink wrap 37 wrapped tightly around them.

Figure 2:
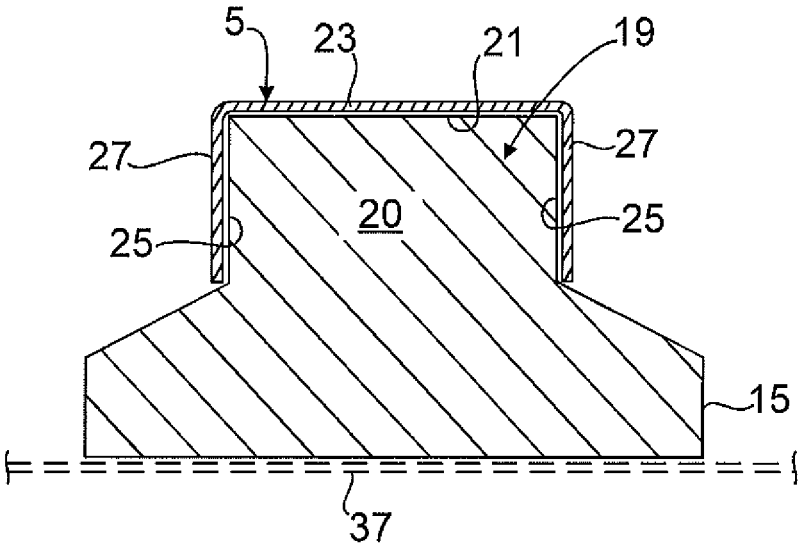
FIG. 2 shows a sectional view in the sectional plane I-I from FIG. 1.

For correct positioning on the household appliance the two packing elements 15 provided at the top at the front have a projection 19 as a positioning aid, this being inserted into the outwardly open U-profile of the support frame 5. Also integrated in the projection 19 of the packing element 15 according to FIG. 2 is the force transfer region 20 of the packing element 15. The projection 19 is a component of the packing element 15 made from the same material and as a single piece, as shown in FIG. 2. The projection 19 is also pressed into contact with its end face 21 configured as a force action surface against a base segment 23 of the support frame 5.

In order to achieve simple pre-positioning of the packing element 15, the edge faces 25 of the projection 19 can be spaced apart from one another so that the packing element 15 is in a clamped connection between the two rising edges 27 of the U-profile-shaped support frame 5.

Figure 3:
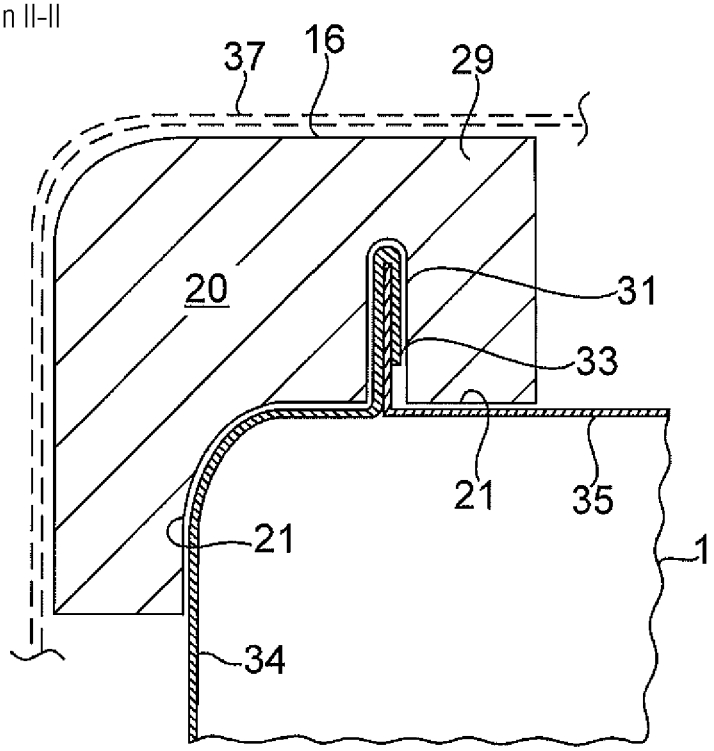
FIG. 3 shows a sectional view along the sectional plane II-II from FIG. 1.

The two packing elements 16 shown in FIG. 1 each cover the outer corners of the wash container 1 at the top at the rear. To this end the two rear top packing elements 16 are configured as roughly shell-shaped. Each of the two packing elements 16 encloses a rear top outer corner of the wash container 1 with a form fit. A recess 31 is provided as a positioning aid according to FIG. 3 on an arm 29 of the packing element 16 engaging across the top wall 35 of the wash container 1. Projecting into the recess 31 is a folded connection point 33 to connect the rear wall 34 to the top wall 35. The recess 31 is enclosed by the force action surface 21, which is in contour-matched contact with the wash container 1.

On both front bottom corner regions of the dishwasher according to FIG. 1 further packing elements 17 are provided, with their force action surfaces 21 in contact with the hinge supports 7. The roughly L-shaped packing elements 17 here are in contact over a large area with the hinge supports 7. The horizontal arm of the illustrated packing element 17 is brought directly up to the hinge lever 13, so that it is located within an outlined pivot path I of the hinge lever 13.

In the two rear bottom corner regions the household appliance according to FIG. 1 has further packing elements 18, which are brought into contact with the bottom assembly support 9.

The two rear top packing elements 16 can optionally by connected to one another by way of an additional wood or plastic strip 39. The strip 39 serves, when lateral clamping forces are introduced, to provide a force path, which bridges the rear top edge region of the wash container 1.

What is claimed is:

1. A household appliance assembly, comprising:

a household appliance having a treatment container which defines a treatment chamber;

at least one packing element including a positioning aid and disposed on a side face of the household appliance, wherein the packing element is adapted to prevent damage to the household appliance due to forces occurring during at least one of storage and transportation of the household appliance, and the positioning aid includes one of a projection and a recess; and the household appliance further comprising at least one load-bearing structural part with a cross-sectional profile that includes the other of the projection and the recess, the at least one load-bearing structural part being positioned externally of the treatment chamber, such that the other of the projection and the recess of the at least one load-bearing structural part is exposed so as to be accessible from outside of the household appliance, wherein the packing element has at least one force transfer region, which has a force action surface in direct contact with the load-bearing structural part, the household appliance is configured to be a built-in appliance that does not have external casing walls at least where the packing element is disposed, and the cross-sectional profile is inserted into the positioning aid or the positioning aid is inserted into the cross-sectional profile such that the projection and the recess are in contour-matched contact.

2. The household appliance assembly of claim 1, constructed in the form of a dishwasher.

3. The household appliance assembly of claim 1, wherein the load-bearing structural part is disposed in an uncovered region of the side face.

4. The household appliance assembly of claim 1, wherein the load-bearing structural part is a member selected from the group consisting of the treatment container, and a support element.

5. The household appliance assembly of claim 1, wherein the positioning aid is a molded segment of the packing element.

6. The household appliance assembly of claim 1, wherein the positioning aid is a molded segment of the force transfer region of the packing element.

7. The household appliance assembly of claim 1, wherein the load-bearing structural part is a frame around a loading opening.

8. The household appliance assembly of claim 7, wherein the cross-sectional profile is an outwardly open U-profile and the frame has at least one outer corner, with the force transfer region of the packing element extending around the outer corner of the frame.

9. The household appliance assembly of claim 8, wherein the at least one outer corner is at least two outer corners and the frame has the two of outer corners.

10. The household appliance assembly of claim 1, wherein the positioning aid includes the recess and the load-bearing structural part includes the projection.

11. The household appliance assembly of claim 10, wherein the load-bearing structural part is the treatment container, and the projection is a folded connection point for connecting wall parts of the treatment container.

12. The household appliance assembly of claim 1, wherein the load-bearing structural part is a hinge support for connection of a hinge lever of an appliance door.

13. The household appliance assembly of claim 12, wherein the force transfer region of the packing element with its force action surface is disposed within a pivot path of the hinge lever.

14. The household appliance assembly of claim 1, wherein the packing element and the force transfer region are a same material.

15. The household appliance assembly of claim 1, wherein the packing element and the force transfer region are a single piece.

16. A packing for a household appliance, comprising at least one packing element, which in a packed state envelopes at least one face of the household appliance and has a positioning aid and a force transfer region, which is in direct contact with a load-bearing structural part of the household appliance, the load-bearing structural part being positioned externally of a treatment chamber of a treatment container of the household appliance, such that the load-bearing structural part is exposed so as to be accessible from outside of the household appliance, wherein the packing element is adapted to prevent damage to the household appliance due to forces occurring during at least one of storage and transportation of the household appliance, wherein the positioning aid includes one of a projection and a recess, wherein the positioning aid is adapted to be inserted into an externally exposed cross-sectional profile of the load-bearing structural part or the externally exposed cross-sectional profile is adapted to be inserted into the positioning aid, wherein the externally exposed cross-sectional profile includes the other of the projection and the recess, and wherein the projection and the recess are configured to be in contour-matched contact.

17. The packing of claim 16, wherein the positioning aid is a molded segment of the packing element.

18. The packing of claim 16, wherein the positioning aid is a molded segment of the force transfer region of the packing element.

19. The packing of claim 16, wherein the positioning aid includes the projection and the externally exposed cross-sectional profile is an outwardly open hollow profile of the load-bearing structural part.

20. The packing of claim 16, wherein the positioning aid includes the recess and the load-bearing structural part includes the projection.

21. The packing of claim 16, wherein the force transfer region of the packing element is disposed within a pivot path of a hinge lever for an appliance door of the household appliance.

22. The packing of claim 16, wherein the packing element and the force transfer region are a same material.

23. The packing of claim 16, wherein the packing element and the force transfer region are a single piece.

24. The household appliance assembly according to claim 1, wherein the load bearing structural part is selected from the group consisting of the treatment container, a support frame, a hinge support and a frame-type assembly support.

25. A household appliance assembly, comprising:

a household appliance having a treatment container which defines a treatment chamber;

at least one packing element including a positioning aid and disposed on a side face of the household appliance, wherein the packing element is adapted to prevent damage to the household appliance due to forces occurring during at least one of storage and transportation of the household appliance, and the positioning aid includes one of a projection and a recess; and the household appliance further comprising at least one load-bearing structural part with a cross-sectional profile that includes the other of the projection and the recess, the at least one load-bearing structural part being positioned externally of the treatment chamber, such that the other of the projection and the recess of the at least one load-bearing structural part is exposed so as to be accessible from outside of the household appliance, the load bearing structural part being selected from the group consisting of the treatment container, a support frame, a hinge support and a frame-type assembly support, wherein the packing element has at least one force transfer region, which has a force action surface in direct contact with the load-bearing structural part, and the cross-sectional profile is inserted into the positioning aid or the positioning aid is inserted into the cross-sectional profile such that the projection and the recess are in contour-matched contact.

26. A household appliance assembly, comprising:

at least one packing element including a positioning aid and disposed on a side face of the household appliance, wherein the packing element is adapted to prevent damage to the household appliance due to forces occurring during at least one of storage and transportation of the household appliance, and the positioning aid includes one of a projection and a recess; and at least one load-bearing structural part with a cross-sectional profile that includes the other of the projection and the recess, wherein the packing element has at least one force transfer region, which has a force action surface in direct contact with the load-bearing structural part, wherein the household appliance does not have housing outer walls where the packing element is disposed, wherein the cross-sectional profile is inserted into the positioning aid or the positioning aid is inserted into the cross-sectional profile such that the projection and the recess are in contour-matched contact, and wherein the load-bearing structural part is a hinge support for connection of a hinge lever of an appliance door.

27. A packing for a household appliance, comprising at least one packing element, which in a packed state envelopes at least one face of the household appliance and has a positioning aid and a force transfer region, which is in direct contact with a load-bearing structural part of the household appliance, wherein the packing element is adapted to prevent damage to the household appliance due to forces occurring during at least one of storage and transportation of the household appliance, wherein the positioning aid includes one of a projection and a recess, wherein the positioning aid is adapted to be inserted into a cross-sectional profile of the load-bearing structural part or the cross-sectional profile is adapted to be inserted into the positioning aid, wherein the cross-sectional profile includes the other of the projection and the recess, wherein the projection and the recess are configured to be in contour-matched contact, and wherein the force transfer region of the packing element is disposed within a pivot path of a hinge lever for an appliance door of the household appliance.

* * * * *